United States Patent [19]

Narihara et al.

[11] 4,115,675

[45] Sep. 19, 1978

[54] INDUCTION HEATING METHOD OF STEEL PIPE

[75] Inventors: Katsuhiko Narihara, Kimitsu; Hajime Nakasugi, Kisarazu; Masanobu Yamaguchi, Kimitsu, all of Japan

[73] Assignee: Nippon Steel Corporation, Japan

[21] Appl. No.: 802,195

[22] Filed: May 31, 1977

Related U.S. Application Data

[63] Continuation-in-part of Ser. No. 603,626, Aug. 11, 1975, abandoned.

[51] Int. Cl.[2] ..... H05B 5/06

[52] U.S. Cl. ..... 219/10.41; 219/10.77

[58] Field of Search ..... 219/8.5, 10.41, 10.43, 219/10.75, 10.77, 10.69; 148/150, 152

[56] References Cited

U.S. PATENT DOCUMENTS 3,610,861 10/1971 Storey et al. ..... 219/10.41

FOREIGN PATENT DOCUMENTS 224,719 12/1968 U.S.S.R.

*Primary Examiner*—Bruce A. Reynolds

*Attorney, Agent, or Firm*—Wenderoth, Lind & Ponack

[57] ABSTRACT

A method for heating steel pipe for induction heating coils, while the pipe is travelling through said coils in the axial direction, which comprises:

(a) calculating the limit absorption electric power density Po (W/cm²) by the followng formula:

$$Po = 1/40 \times T \times \sqrt{d}$$

where $T$ = heating temperature (° C) and $d$ = wall thickness (mm);

(b) attaching a power supply of low frequency to the induction heating coils;

(c) setting said power supply for maximum capacity to be impressed to said induction heating coils, and (d) heating the steel pipe as it is travelling through said induction heating coils heated by said power supply, at such speed as to permit the steel pipe to be heated to the desired temperature, and heating the steel pipe with the set power if the absorption electric power density P by the set power is $P \geqq Po$, and heating the steel pipe by shortening the effective length of the induction heating coils to obtain $P \geqq Po$ if $P \leqq Po$; thereby causing the difference in the temperature between the ends and the central portion of the steel pipe in the axial direction to be no greater than about 20° C.

3 Claims, 7 Drawing Figures

INDUCTION HEATING METHOD OF STEEL PIPE

This is a continuation-in-part of Ser. No. 603,626 filed Aug. 11, 1975, abandoned.

BACKGROUND OF THE INVENTION

The present invention relates to a method for the induction heating of steel pipe, and more particularly to a method for performing uniform induction heating of the steel pipe in its axial direction while moving the steel pipe in its axial direction.

In performing the induction heating of the long steel pipe with commercial electric power, a method of heating the steel pipe while shifting the steel pipe in the coil of the fixed induction furnace is usually employed. As one factor in obtaining a satisfactory heating effect, the soaking of the steel pipe in its longitudinal direction is required in this case.

A matter that becomes particularly problematic in the soaking of the steel pipe in its longitudinal direction, is that a temperature differential exists between the middle portion and the pipe end. For example, when the heating treatments such as hardening and tempering are performed, the pipe end is not controlled within the desired temperature differential with respect to the middle portion of the steel pipe, with the result that a satisfactory heat treatment cannot be performed and adverse effects arise such as the fact that the desired properties of material and shape at the pipe end are not obtained and also that deterioration of yield due to the discarding of the inferior portion occurs.

The temperature difference between the middle portion and the pipe end as mentioned in the foregoing is caused by the difference in the heat radiation of the pipe end and the middle portion as well as the temperature gradient accompanied by the transfer heating, and in normal cases, such problems cannot be avoided.

To eliminate the temperature difference, a variety of methods have been proposed such as an auxiliary heating method using an auxiliary heating apparatus, a continuous processing method, a method of providing a soaking zone, and a method of adjusting electric power, but each method has its specific problem as will be described in the following and therefore none of them is an effective means for solving the problems.

(a) Auxiliary heating method

In this method, auxiliary heating is applied only to the temperature lowered portion of the pipe end before or after the main heating, but the conditions of the main heating operate delicately on the auxiliary heating and it requires complicated adjustments whereby the stabilized conditions cannot be obtained.

(b) Continuous processing method

This method involves continuously heating the front and rear steel pipes which are abutted at their ends; the dimension of the pipe end or the perpendicularity to the pipe axis are irregular and as a result, the abutted condition where the pipe ends of the front and rear pipes are not tightly abutted, cannot be obtained.

Also, there has been employed a similar method of connecting a dummy piece to the front and rear steel pipes, but disadvantages such as the loss of the dummy piece or the deteroriation of the work efficiency are great.

(c) Soaking zone method

This method generally employs an ordinary heating furnace, but in case of the internal heat generating system of the steel material, as in the case of he induction heating, it requires a separate installation for the indirect heating (for example, gas furnace) and it is meaningless as the heating characteristics is spoiled.

(d) Power adjusting method

This involves detecting temperature in the vicinity of the pipe end during the heating operation, and compensating for the temperature fluctuation by the adjustment of the heating electric power to be impressed, but it is not economical due to the complicated control requirements and equipment according to a variety of conditions.

Under the foregoing circumstances, in the induction heating of the steel pipes, the development of a simple heating method of great utility which solves the foregoing problems has been desired.

SUMMARY OF THE INVENTION

The present invention has solved the problems above mentioned in connection with the conventional induction heating of steel pipe.

An object of the present invention is to provide a method of induction heating of steel pipe which is capable of uniformly heating the pipe in its longitudinal direction whereby the properties of material and shape of the pipe end can be improved.

Another object of the present invention is to provide a method of induction heating of steel pipe which can be applied immediately to the existing induction heating installations and is capable of performing the method at low installation and operating costs.

Still another object of the present invention is to provide a method of induction heating of steel pipe whereby the heating time becomes short and the work efficiency is improved.

In order to achieve the foregoing objects, in a method of heating the steel pipe by an induction coil while shifting the pipe in its axial direction, the induction heating method of steel pipe according to the present invention is characterized by determining absorption power density at which the temperature differential between the pipe end in its axial direction and the middle portion in its axial direction is set below a desired value and adjusting an electric power to be supplied to the induction coil so as to obtain the absorption electric power density.

DESCRIPTION OF THE PREFERRED EMBODIMENT

The present inventors have noted that the temperature difference caused between the middle portion of the steel pipe and the pipe end is greatly influenced by the heating time, and as a result of performing many experiments repeatedly, we succeeded in shortening the heating time and reducing the temperature difference by applying certain specific conditions. The present invention is characterized in that the optimum conditions have been found which make it possible to shorten the heating time.

The present invention will be described in detail by referring to an example of the induction heating by commercial electric power with respect to large diameter steel pipe.

Figure 1:
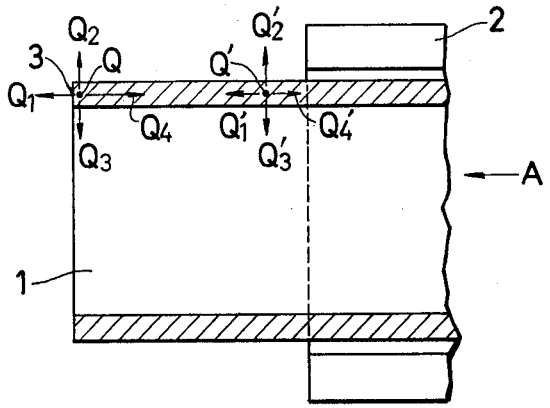
FIG. 1 is a view showing the condition where the heat applied to the steel pipe end is shifted.

In FIG. 1, the steel pipe 1 passes through the coil 2 of the induction heating furnace while shifting it in the direction of an arrow A so as to be heated at a desired temperature.

In the end portion 3 of the steel pipe which is to be heated, namely the point Q, the heat is considered to be radiated externally at Q1, Q2, and Q3 and internally at Q4.

While in the middle portion of the steel pipe, namely the point Q′, Q2′ represent the external heat radiation under almost the same condition with the Q2, but with respect to the other Q1′, Q3′ and Q4′, the respective conditions differ. Particularly, with respect to the Q1 and Q1′, at the Q1, external heat radiation takes place while at the Q1′, the transfer of heat is not present and the temperature difference is remarkably great.

In general, the temperature difference ΔT between the pipe end and the middle portion of the steel pipe results from the difference caused by radiation at Q1, Q3 and Q4.

The normal value of the temperature difference ΔT becomes, for example, 40° C. to 80° C. in Table 1 as will be described hereinafter, and it is not unusual that the further greater values appear.

The present inventors determined that the temperature differential which does not pose practical problems with respect to quality of product, namely the allowable temperature differential ΔT′ is around 20° C. Accordingly, in the case where allowable temperature range ΔT′ is exceeded shown in FIG. 2, the length of the pipe end *l*1 which corresponds to the portion exceeding the range is discarded.

This temperature difference ΔT is subject to fluctuation whose principal causes are heating time, heating temperature and wall thickness of the heated steel pipe. Incidentally, the heating time is obviously determined by the transfer speed of the steel pipe and the length of the induction coil.

The present inventors conducted experiments repeatedly by an installation of a practical apparatus, determine the relationship between the temperature difference ΔT and the heating time, heating temperature and wall thickness of steel pipe, and conducted tests in a variety of modes to review the relationship between each factor, namely, heating time, heating temperature, wall thickness of steel pipe and the temperature difference ΔT by changing said factors with a view to finding the most practical favorable conditions.

Figure 2:
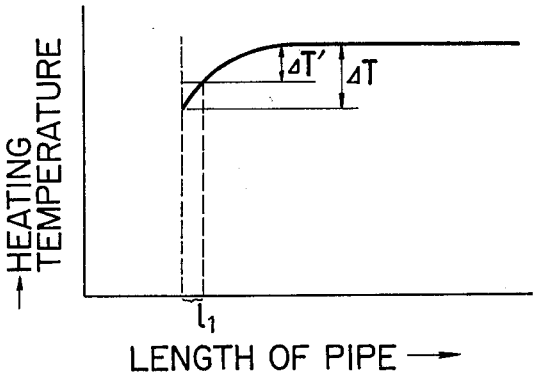
FIG. 2 is a graph showing the condition where the temperature of the heated pipe changed along the axial direction in the vicinity of the steel pipe end.
Figure 3:
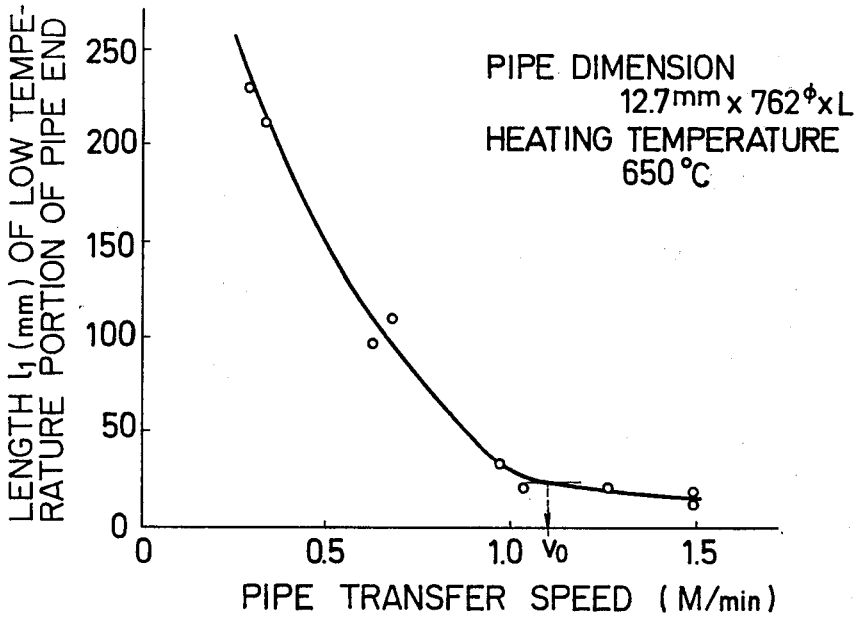
FIG. 3 is a graph showing the relationship between the pipe transfer speed and length of the low temperature portion at the pipe end.

In the first place, the inventors found out that the length *l*1 of the pipe end exceeding the allowable temperature difference ΔT′ as shown in FIG. 2, became rapidly smaller due to the increment of the transfer speed V of the steel pipe which is shown in FIG. 3. The transfer speed Vo of the steel pipe, of which the length *l*1 is equal to two times of the pipe wall thickness d, is obtained for each heating temperature T, and conditions of induction coil and dimension of the material to be heated are obtained by conducting the various tests.

In this case, if the heating temperature of the steel pipe is determined, without regard for the condition of the induction coil, it should be noted that the calories per unit weight required for heating the steel pipe to a predetermined temperature are constant. Therefore, if the dimensions of the induction coil are constant, the calories absorbed per unit time and also per unit surface area, namely, the absorption electric power density P (electric power to be absorbed per unit area) is proportional to the transfer speed v of the steel pipe. Namely, $v = kp$, provided that $k$ is constant. In order to apply a fixed number of calories to the steel pipe, when the transfer speed $v$ becomes increased, the absorption electric power density $p$ must be increased proportionally. Accordingly, if the dimension of the induction coil is constant, in order to obtain the relationship between the transfer speed $v$, pipe wall thickness $d$ and heating temperature T, the transfer speed $v$ or the absorption electric power density $p$ may be varied.

The absorption electric power density P can be defined by the foregoing, but it is substantially equal to the following formula.

$$P = \frac{W}{\pi D L} \tag{1}$$

Where W denotes supply electric power to the induction heating coil, and D denotes pipe diameter, and L denotes an effective length of the heating coil. Also, the heat to be adsorbed by the pipe is equal to the Joule heat by induced current generated in the wall of the pipe due to the induction action.

Figure 4:
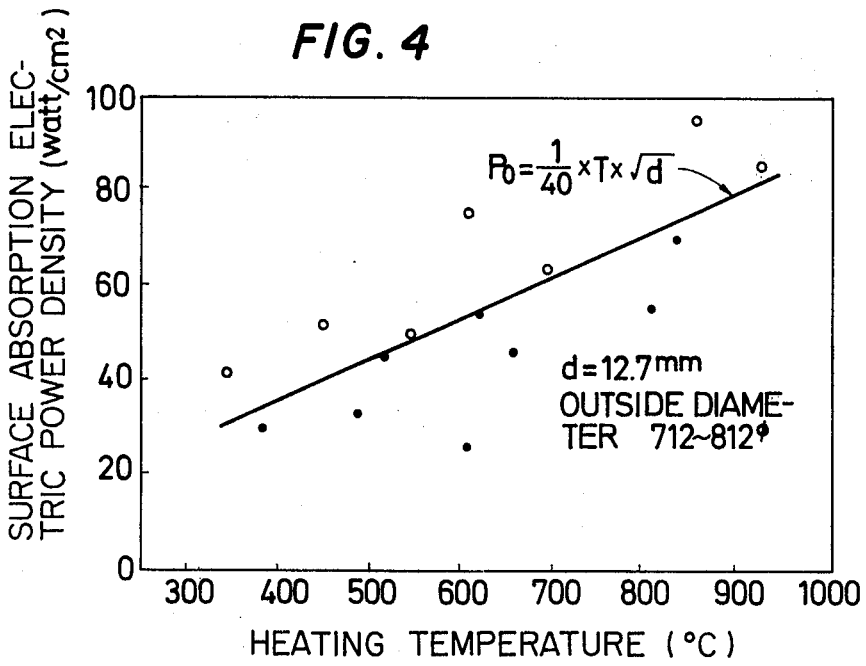
FIG. 4 is a graph showing the relationship between the heating temperature and the absorption electric power density.

Next, the present inventors conducted various tests with respect to the pipe wall thickness to determine the relationship between the heating temperature and the adsorption electric power density, and as a result, where the pipe wall thickness is constant, the heating temperature and the adsorption electric power density have been found to be in linear relationship. As an example of this finding, the relationship of the absorption electric power density P ($w/cm^2$) and the heating temperature T (° C.) in the case where the pipe wall thickness is 12.7 mm and the outside diameter of pipe is 762 mm is shown in FIG. 4. In FIG. 4, the *o* mark represents the heating condition where the pipe end inferior portion length *l* 1 is equal to or smaller than 2 × (pipe wall thickness *d*), and the · mark represents the heating condition where the length *l*1 is bigger than 2*d*. As will be obvious from FIG. 4, the relationship between the limit absorption electric power density P*o* and the heating temperature T is linear.

Figure 5:
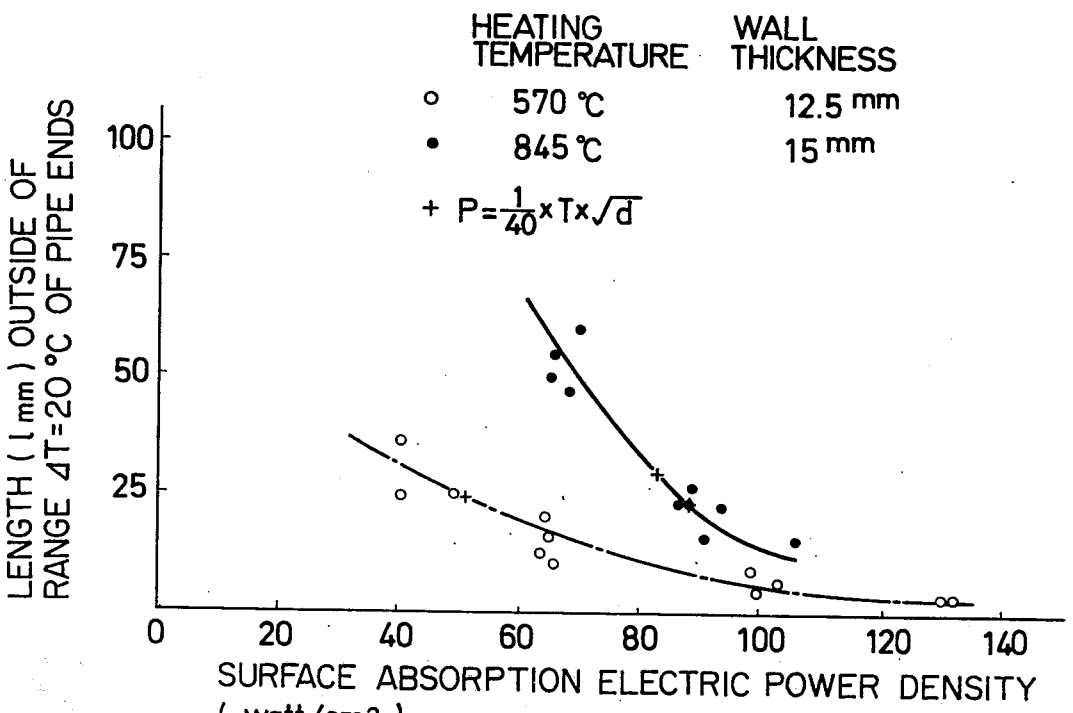
FIG. 5 is a graph showing the relationship between the absorption electric power density and the length of the discarded pipe end.

The foregoing tests were conducted with a pipe wall thickness of 6–40 mm, pipe diameter 500–1400 mm and heating temperature 300°–950° C. and the each fluctuating factor mentioned above, namely, the heating time, heating temperature and pipe wall thickness was controlled by varing the absorption of electric power on the surface of the pipe and this was employed as the representative factor. The analysis was conducted by relating the absorption of electric power to the temperature difference. As a result, it was discovered that the absorption electric power on the surface of the pipe became equal to the electric power density, and therefore if the unit surface area of the steel pipe was employed as the electric power density, the heating time was almost proportional to the heating temperature and the pipe wall thickness and was in inverse proportion to the electric power density, and therefore by controlling the relationship between the electric power density with the heating temperature and the pipe wall thickness, the temperature difference $\Delta T$ of the pipe end could be reduced. One example of such a result is shown in FIG. 5.

Figure 6:
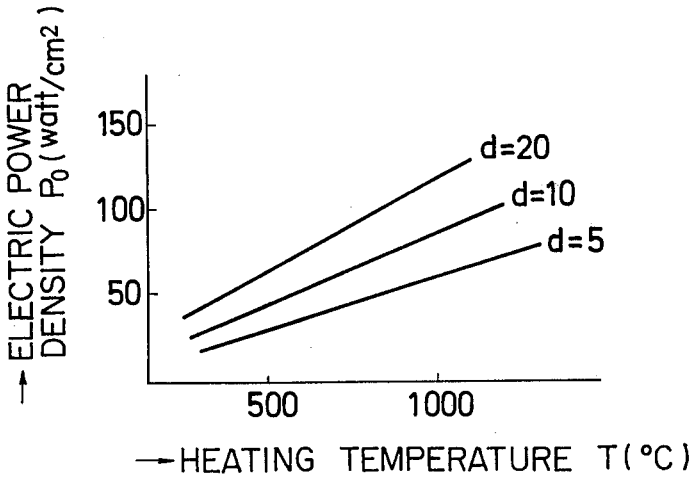
FIG. 6 is a graph showing the relationship between the heating temperature and the absorption electric power density and the pipe wall thickness.

FIG. 6 shows the actual relationship between the heating temperature, pipe wall thickness and absorption electric power density. FIG. 6 shows the limit value $Po$ of the absorption electric power density necessary for the maintenance of the temperature at the pipe end, so that the temperature difference $\Delta T$ is adjusted to a degree where there is no problem, for practical purposes. When the limit characteristics shown in FIG. 6 are represented by the absorption electric power density $Po$ (watt/cm$^2$), heating temperature T(° C.) and pipe wall thickness d(mm), a formula similar to the following empirical formula can be obtained.

$$Po = \frac{1}{40} \times T \times \sqrt{d} \tag{2}$$

Accordingly, in order to reduce the temperature fluctuation of the pipe end, it is preferable to set the absorption electric power density $p$ at a value above the $Po$ value represented by the empirical formula. Namely, mean effective heating electric power may be such that is corresponds to the absorption electric power density satisfying the following relative formula constantly.

$$P \geqq \frac{1}{40} \times T \times \sqrt{d} \tag{3}$$

To accomplish the object of the present invention, the following considerations shall be given from the step of installation of the induction heating apparatus.

In the first place, maximum capacity $W_{max}$ to be impressed to the coil can be determined by $$W_{max} = \alpha(C, T\max, G\max) \tag{4}$$

based on a maximum heating temperature ($T_{max}$) and maximum treating capacity ($G_{max}$) of heating furnace. Where $\alpha$ denotes a constant including conversion of units and efficiency of coil, and C denotes a mean specific heat (KWH/TON, ° C.) of the steel pipe to be heated, and $T_{max}$ denotes a maximum heating temperature of the pipe to be treated by the installation, and $G_{max}$ is a maximum heating capacity of the heating coil at the manufacturing plant of the pipe and represents a treating weight (TON/Hr) of the pipe per unit time.

In this case, the most desirable thing to achieve the object of the present invention is to determine L so that the following formula (5)

$$W_{max} \geqq \pi DLPo \tag{5}$$

is satisfied by the $W_{max}$ of the formula (4) with respect to the diameter D of all the pipes to be treated by this installation (in many cases, $500^{mm}$–$1650^{mm}$) and length of the coil L (this L is preferably shorter on account of preventing deformation). In the formula (5), $Po$ is to be determined by the formula (2).

However, in general, so far there were no such large capacity as like $W_{max}$ to be determined by the formula (5) in the past.

For example, where $D_{max}$ = 160 cm, $T_{max}$ = 950° C. $d_{max}$ = 3 cm, L = 300 cm, the capacity of the coil would become $Po$ = 41 W/cm$^2$, $W_{max} \approx$ 6200 KW.

Namely, in determining the coil capacity heretofore, in no case has it been determined from uniform heating characteristics in the pipe axial to the direction of the heating coils, and normally it is determined from capacity of the installation. For this reason, the desired absorption electric power density cannot be obtained, and as a result, the uniform heating in the axial direction has been found difficult.

The present inventors paid attention to this point and conducted tests and found that the object of the present invention can be achieved as the uniform heating method of axial direction of the pipe in case the coil maximum capacity $W_{max}$ is relatively small on the ground that $$W_{max} = \pi DLP \tag{6}$$

the absorption electric power density P becomes $$P = \frac{W_{max}}{\pi D L} \geqq Po \tag{7}$$

where pipe diameter is D, and coil length is L. Consequently, as shown in the following, the object can be achieved by changing the coil length L.

For the pipe D = Do having $$P = Po = \frac{W_{max}}{\pi DL},$$

it is treated by the coil length $L = L$, and for the pipe whose pipe diameter D > Do, it is treated by the coil length $L = L'$ (L' < L), and thus P ≧ $Po$ is obtained by shortening the coil length L to L' on account of DoL ≧ DL'.

To accomplish the foregoing method, it is advisable to prepare more than several pieces of taps for the coil, for example L, 0.75 L and 0.5L so that the coil length can be easily changed at the time of manufacturing of the coil.

Where the coil is too short, magnetic field results in lack of uniformity, deteriorating the coil efficiency, and on the contrary, if the coil is too long, the portion of the pipe to be heated becomes longer, easily causing the deformation of the pipe.

In general, proper length of the coil is considered to be 1–5 m.

Incidentally, the upper limit value of the absorption electric power density P is about 150 W/cm$^2$ for practical purposes where the induction heating is performed by the commercial electric power, namely, low frequency such as frequency of 50 or 60 Hz since the vibration of the coil becomes great due to greater electric power density thereby to cause damages of insulating material. Also, as the heating time is determined by the length of the induction coil and the absorption electric power density, it is preferable to determine specifications of the heating installation so that the time is set for 2–10 minutes from the standpoint of the fact that if the heating time is too short, treating temperature becomes too high due to rapid heating causing deterioration of the pipe material and if it is too long, the pipe is easily deformed.

The method of heating the pipe by the induction heating furnace which is designed to perform as described in the foregoing will be explained concretely as follows.

Figure 7:
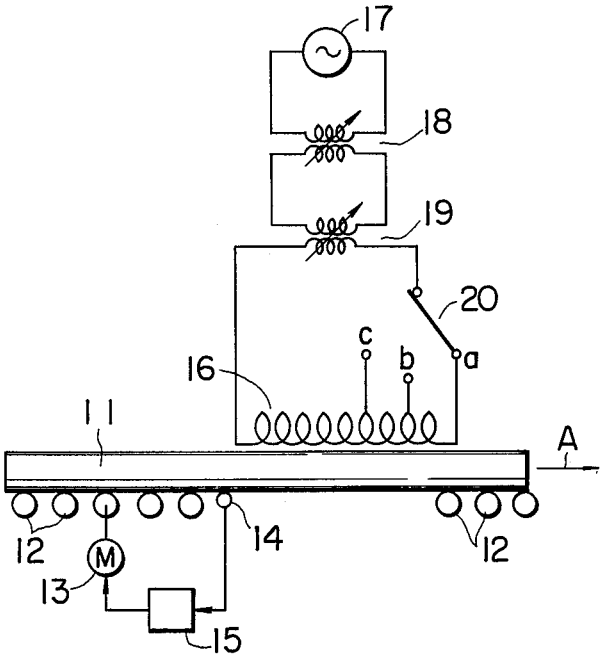
FIG. 7 is a schematic drawing of the induction heating apparatus that puts the method of the present invention into practice.

FIG. 7 is a schematic drawing showing one example of the apparatus that puts the method of the present invention into practice.

A pipe 11 is transferred in the direction marked with an arrow A by means of a roller table 12 for carrying driven by a motor 13. Transfer speed is detected by a speedometer 14, and a detecting signal is transmitted to a speed control device 15. The rotating speed of the motor 13 is controlled by an output signal from the speed control device 15, and the pipe 11 is transferred at a required fixed speed by the roller table 12.

An induction heating coil 16 is supplied wth electric power by means of an AC power source 17 and an induction regulator 18 and a transformer 19. The supply power is roughly adjusted by the transformer 19 and is finely adjusted by the induction regulator 18. Also, taps are taken out from the middle of the coil 16 and effective length L can be changed by a tap changer 20.

In the first place, before the operation, limit absorption electric power density Po is obtained from the foregoing formula (2) on the basis of wall thickness of the pipe to be heated and heating temperature. The following operating conditions are determined previously by the Po, and transfer speed of the pipe, and electric power supplied to the induction heating coil are determined. The operating conditions determined in the foregoing maintain fixed values without particular adjustments during the operation.

Where the electric power to be preset is Wo, the absorption electric power density P in this condition becomes as follows, $$P = \frac{Wo}{\pi DL} \tag{8}$$

and in order to heat the pipe uniformly, the following formula must be satisfied.

$$P \geqq Po \tag{9}$$

Now, assuming that the formula (9) is satisfied, the electric power Wo which is previously set heats the pipe with the same magnitude of the electric power. The transfer speed of the pipe at this time is set by the following.

$$V = \frac{Wo}{\pi Dd\alpha C\rho T} \tag{10}$$

Next, where formula (9) is not satisfied, namely, where $P < Po$, the supply electric power W and/or effective coil length L are adjusted.

In case the supply electric power W is adjusted, W is set to W1 which satisfies the following formula, $$W_1 \geqq \pi DLPo \tag{11}$$

and $$W_1 \geqq \alpha cTG \tag{12}$$

The transfer speed of the pipe at this time is set to the following.

$$V_1 = \frac{W_1}{\pi Dd\alpha c\rho T} \tag{13}$$

Also, where the supply of electric power W is left as it is and the effective coil length L is adjusted, L is set to $L_1$ which satisfies the following formula.

$$L_1 \leqq \frac{W}{\pi DPo} \tag{14}$$

The effective length L at this time is to be shortened, but it can be achieved by changing the tap (a) to (b) or to (c) by manipulating the tap changer 20 shown in FIG. 7. Of course, even if only the coil effective length L is changed, the supply electric power W must satisfy the following formula.

$$W \geqq \alpha TcG \tag{15}$$

Also, the transfer speed v of the pipe at this time is determined by the foregoing formula (10).

In the foregoing case, either the supply electric power W and the coil effective length L is adjusted, but both may be adjusted to provide $P \geqq Po$.

In general, the electric power Wo to be previously set is set to the coil maximum capacity $W_{max}$ to utilize the capacity of the installation to a maximum degree. (Namely, normally it is set to $Wo = W_{max}$). Incidentally, as described in the foregoing, since $P > 150$ W/cm² is preferable, in case P exceeds 150 W/cm², $W'o = 150 \times \pi DL$ is obtained from the formula (8) on the assumption of $P = 150$ W/cm², and the set electric power Wo is adjusted to W'o. (namely, $W'o \leqq W\ max$) Also, the heating time is preferably for 2–10 minutes, the adjustment of Wo is made to obtain the following formula.

$$L/10 \leqq v \leqq L/2 \tag{16}$$

Namely, in case $V > L/2$ (heating time is less than 2 minutes), the set electric power Wo is adjusted to W"o where $V = L/2$ in the formula (10).

In case $v < L/10$ (heating time exceeds 10 minutes), W'''o is obtained as $V = L/10$ in the formula (10), and Wo''' is substituted with the formula (8) to obtain P''', and in case $P''' \geqq Po$, the set electric power Wo is adjusted to Wo'''.

Also, in case $P''' \geqq Po$, Wo''' and $P = Po$ are substituted with the formula (8) to obtain $L_1'''$ so that the set electric power Wo is adjusted to Wo''', and the coil length L is changed over to $L_1'''$ ($L_1''' < L$).

The set electric power Wo is set by adjusting the transformer 19 and/or the induction regulator 18 as described in the foregoing, and the transfer speed of the pipe 11 is set to a required speed by the speed control device 15.

In the actual operation, adjustment of the supply electric power W is troublesome, and therefore the supply electric power W is set to a constant and $W_{max}$ as much as possible. Accordingly, where $P \geqq Po$, the operation is accomplished by the set electric power, and where $P < Po$, the effective coil length L is shortened ($L = L_1$) to accomplish the operation. With this adjustment, installation cost of the induction heating apparatus can be reduced and the heating operation can be greatly simplified.

Table 1 shows embodiments and comparison examples by the method of the present invention and a method other than said method of the present invention.

Table 1

| Item | by a method other than invention A | by a method other than invention B | by a method of invention A | by a method of invention B | by a method of invention C |
|---|---|---|---|---|---|
| heating furnace coil capacity | 2000 kw | 2000 kw | 2000 kw | 2000 kw | 2000 kw |
| coil effective length | 830 mm | 830 mm | 830 mm | 830 mm | 600 mm |
| coil size | for 30" O.D.pipe | for 30" O.D.pipe | for 30" O.D.pipe | for 30" O.D.pipe | for 30" O.D.pipe |
| material to be heated kind | u ϕ steel pipe | U ϕ steel pipe | U ϕ steel pipe | U ϕ steel pipe | U ϕ steel pipe |
| outside dia. | 762 mm | 762 mm | 762 mm | 762 mm | 762 mm |
| Wall thickness (d) | 9.6 mm | 9.6 mm | 9.6 mm | 9.6 mm | 9.6 mm |
| heating temperature (T) | 650° C | 650° C | 650° C | 650° C | 900° C |
| heating speed (transfer speed) | 0.5 M/min | 0.7 M/min | 0.9 M/min | 1.2 M/min | 0.8 M/min |
| limit surface absorption electric power density (Po) | 50 | 50 | 50 | 50 | 50 |
| surface absorption electric power density (P) | 30 W/cm² | 41 W/cm² | 54 W/cm² | 77 W/cm² | 138 W/cm² |
| temperature difference (ΔT) | about 80° C | about 40° C | about 18° C | about 10° C | about 8° C |
| evaluation | poor | poor | good | good | good |

As described in the foregoing, the present invention has many advantageous points in that it is now possible to obtain satisfactory heating effect by merely selecting the absorption electric power density according to the relative formula whereby the rapid heating is not disturbed, and which is a function of the induction heating and also where a complicated control device is not required.

Also, a description has been provided with respect to the embodiment of a large diameter steel pipe, but it can be applied not only to large diameter steel pipes but also to other steel pipes in general and moreover it can be applied to steel materials other than the steel pipes, for example, to hollow steels having similar heating a effect.

What is claimed is:

1. A method for heating steel pipe by induction heating coils, while the pipe is travelling through said coils in the axial direction, which comprises:

(a) calculating the limit absorption electric power density Po (W/cm²) by the following formula:

$$Po = 1/40 \times T \times \sqrt{d}$$

wherein $T$ = heating temperature (° C.) and $d$ = wall thickness (mm);

(b) attaching a power supply of low frequency to the induction heating coils;

(c) setting said power supply for maximum capacity to be impressed on said induction heating coils, and (d) heating the steel pipe as it is travelling through said induction heating coils heated by said power supply, at such speed as to permit the steel pipe to be heated to the desired temperature, and heating the steel pipe with the set power if the absorption electric power density P by the set power is $P \geqq Po$, and heating the steel pipe by shortening the effective length of the induction heating coils to obtain $P \geqq Po$ if $P < Po$; thereby causing the difference in the temperature between the ends and the central portion of the steel pipe in the axial direction to be no greater than about 20° C.

2. A method as defined in the claim 1 in which heating of the steel pipe by the induction coil is performed in 2 to 10 minutes.

3. A method as defined in the claim 1 in which the absorption electric density is below 150 w/cm².

* * * * *